US006877673B2

(12) United States Patent
Foster

(10) Patent No.: US 6,877,673 B2
(45) Date of Patent: Apr. 12, 2005

(54) FLOATING FOUNTAIN DEVICES AND SYSTEMS

(76) Inventor: Richard S. Foster, 3344 Eagle Nest Point, Virginia Beach, VA (US) 23452

( * ) Notice: Subject to any disclaimer, the term of this patent is extended or adjusted under 35 U.S.C. 154(b) by 397 days.

(21) Appl. No.: 10/027,415

(22) Filed: Dec. 21, 2001

(65) Prior Publication Data

US 2003/0116638 A1 Jun. 26, 2003

(51) Int. Cl.[7] ..... B05B 17/08

(52) U.S. Cl. ..... 239/17; 239/23; 239/513; 239/550; 239/556

(58) Field of Search ..... 239/16, 17, 21, 239/22, 23, 211, 273, 279, 513, 514, 505, 569, 551, 562, 548, 556, 550, 558; 261/91, 120; 210/242.1, 242.2; 4/492, 496

(56) References Cited

U.S. PATENT DOCUMENTS

| | | | | | |
|---|---|---|---|---|---|
| 2,240,611 | A | | 5/1941 | Derdeyn | |
| 2,248,386 | A | * | 7/1941 | Richardson | 239/17 |
| 2,745,697 | A | * | 5/1956 | Pearse | 239/20 |
| 2,970,771 | A | * | 2/1961 | Przystawik | 239/17 |
| 2,974,872 | A | * | 3/1961 | Rodman | 239/20 |
| 3,030,028 | A | * | 4/1962 | Hruby, Jr. | 239/17 |
| 3,307,787 | A | * | 3/1967 | Hall, Jr. | 239/17 |
| 3,318,528 | A | * | 5/1967 | Williams | 239/17 |
| 3,337,134 | A | * | 8/1967 | Bond | 239/556 |
| 3,503,554 | A | * | 3/1970 | Clifton | 239/23 |
| 3,889,880 | A | * | 6/1975 | Hruby, Jr. | 239/18 |
| 3,912,169 | A | | 10/1975 | Lodge | |
| 4,088,880 | A | * | 5/1978 | Walsh | 239/18 |
| 4,174,808 | A | | 11/1979 | Latin | |
| 4,519,544 | A | | 5/1985 | Szabo | |
| 4,562,963 | A | | 1/1986 | Butler | |
| 4,844,341 | A | * | 7/1989 | Alba | 239/18 |
| 4,920,465 | A | | 4/1990 | Sargent | |
| 5,052,343 | A | | 10/1991 | Sushelnitski | |
| 5,069,387 | A | * | 12/1991 | Alba | 239/18 |
| 5,273,214 | A | | 12/1993 | Huffstutler | |
| 5,480,336 | A | | 1/1996 | Blanchard | |
| 5,934,563 | A | | 8/1999 | Gapco | |
| 6,276,612 | B1 | * | 8/2001 | Hall | 239/17 |
| 6,435,422 | B1 | * | 8/2002 | Wutschik | 239/23 |

OTHER PUBLICATIONS

The Atlantic Fountain Company, http://www.atlanticfountains.com.
Floating Fountain Products, http://www.atlanticfountains.com/catff.pdf.
Lake Fountains and Aeration, Inc., http://www.lakefountains.com.
Custom Fountains, Inc., http://www.customfountains.com.
Desert Rain Floating Fountains, http://www.desertrain.net.

* cited by examiner

*Primary Examiner*—Steven J. Ganey
(74) *Attorney, Agent, or Firm*—Bowman Green Hampton & Kelly, PLLC

(57) ABSTRACT

A floating fountain that includes of a tubular, hollow base assembly that can be connected to a pressurized source of fluid, a primary nozzle member located centrally to the base assembly, and a plurality of secondary nozzle members located on the base assembly. Each nozzle member is connected to the base assembly such that pressurized fluid may be communicated from the base assembly to the primary nozzle member and the secondary nozzle members in a manner that allows the pressurized fluid to be organized into separate streams of fluid, which extend from each respective nozzle member. A float body is affixed to a bottom side of the base assembly to provide buoyancy to the floating fountain device. Additionally, an infinitely variable valve is included between the pressurized source of fluid and the base assembly so that the pressure at which the pressurized fluid enters the base assembly and is provided to each nozzle member may be variably controlled.

35 Claims, 9 Drawing Sheets

FLOATING FOUNTAIN DEVICES AND SYSTEMS

BACKGROUND OF THE INVENTION

1. Field of the Invention

This invention relates generally to floating fountains.

2. Description of Related Art

Generally, water fountains are considered to be esthetically pleasing, and are often seen as part of the landscaping in housing communities, golf courses, parks, resorts, and the like. Floating fountains not only bring beauty to a well-landscaped area, but also provide aeration to lakes and ponds. While creating an attractive spray display, floating fountains aerate the water in the lake or pond in which they are situated by adding movement and oxygen to the water.

Known floating fountains typically consist of a float with a pump motor suspended below it. The float is generally held in position in a lake by shoreline ropes or ropes anchored to, for example, concrete blocks at the bottom of the lake. The input to the pump is submerged below the surface of the water and the output of the pump typically includes a nozzle, which allows an output stream of water to be diffused in a particular fountain display pattern, such as, for example, a rocket, trumpet, or cascade.

Typical floating fountain pump motors range from ½ HP to 2 HP and require either a 115V single phase or a 230V single or three phase electrical input. To increase the size or height of a floating fountain's display pattern, the size of the pump motor is usually increased. For example, a floating fountain with a ½ HP, 115V pump motor may produce a 12 foot tall cascade, while a 2 HP, 230V pump motor may produce a 25 foot tall cascade.

SUMMARY OF THE INVENTION

Unfortunately, known floating fountains are expensive and difficult to install and maintain. For example, because the pump motor of a typical floating fountain is suspended in a body of water, electricity must be supplied from a power source on shore to the pump motor in the water. Usually this requires that electricity be supplied from the power source to a control panel, from the control panel to a Ground Fault Circuit Interrupter (GFCI), and from the GFCI to the pump motor circuit. The GFCI is necessary to reduce the risk of electrical shock if a short develops in this system. Furthermore, to provide an adequate flow of electricity from the control panel on the shore to the pump motor in the water, an underwater electrical cable must be used. This cable is typically a large gauge, un-spliced, electrical cable, which includes a specialized jacket designed to shield the cable from destruction by animals and the effects of long term submersion in water. If the integrity of this electrical cable becomes compromised, due to corrosion, age, or destruction by animals, the entire electrical cable must be replaced. Thus, the services of a licensed commercial electrician or a certified installer are usually needed to install and maintain a floating fountain.

Furthermore, due to the rotation of components within the pump motor, it is often difficult to maintain the desired positioning of a floating fountain in a lake. Once the floating fountain is positioned, the mere operation of the fountain's pump motor tends to cause the fountain to rotate and travel across the lake. Although this travel can be countered by securing the floating fountain with multiple shore or anchor lines, if one of the lines gives way, the floating fountain may move into a shallow portion of the lake where the water flow through the pump motor may become insufficient or debris may be sucked into the motor.

Therefore, this invention provides floating fountain devices and floating fountain systems that reduce or eliminate these and other problems inherent in known floating fountains. In various exemplary embodiments of a floating fountain device, according to this invention, the floating fountain comprises a tubular, hollow base assembly with a connection member that is capable of being connected to a pressurized source of fluid. The floating fountain also includes a primary nozzle member located centrally to the base assembly, and a plurality of secondary nozzle members located on the base assembly. Each nozzle member is connected to the base assembly such that pressurized fluid may be communicated from the base assembly to the primary nozzle member and the secondary nozzle members in a manner that allows the pressurized fluid to be organized into separate streams of fluid, which extend from each respective nozzle member. A float body is also affixed to a bottom side of the base assembly, to provide buoyancy to the floating fountain device.

In various exemplary embodiments of a floating fountain system, according to this invention, the floating fountain device is coupled to a pressurized source of fluid, such as an existing irrigation system. Typical irrigation systems, such as those at resorts, parks, golf courses, or private residences, usually include a pump or a pump station and a series of existing pressurized fluid supply lines. The floating fountain systems of this invention allow, for example, a pressurized fluid supply line from the irrigation system's pump or pump station to supply the necessary pressurized fluid. In various exemplary embodiments, the floating fountain system also includes an infinitely variable valve disposed in the pressurized fluid supply line between the irrigation system's pump station and the connection member so that the pressure at which the pressurized fluid enters the base assembly and is provided to each nozzle member may be varied.

Because of the primary nozzle member's location in relation to the connection member and the flow of the pressurized fluid within the base assembly, the pressurized fluid is communicated to the primary nozzle member at a higher pressure than it is communicated to the secondary nozzle members. Therefore, by selectively adjusting the infinitely variable valve and selectively blocking certain of the secondary nozzle members, a variety of fountain display patterns, such as, a rocket, trumpet, or cascade, can be produced by the streams of fluid that are output from the primary and the secondary nozzle members.

Accordingly, this invention provides floating fountain devices and systems, which utilize an existing pressurized source of fluid, such as an existing irrigation system, to create a fountain display.

This invention separately provides floating fountain devices and systems that do not require the use of local, submersible pump motors.

This invention separately provides floating fountain devices and systems that do not require the use of underwater electrical cable, the installation of additional GFCIs, or separate electrical control panels.

This invention separately provides floating fountain devices with improved stability and no rotational tendencies.

This invention separately provides floating fountain devices and systems wherein the height of a fountain display pattern may be altered without altering the physical characteristics of floating fountains.

This invention separately provides floating fountain devices and systems that have a substantially simplified design.

These and other features and advantages of this invention are described in or are apparent from the following detailed description of the exemplary embodiments, the accompanying drawings, and/or the appended claims.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF THE PREFERRED EMBODIMENT

For simplicity and clarification, the design factors and layout of the floating fountain devices and systems according to this invention are explained with reference to several exemplary embodiments of a floating fountain according to this invention. The basic explanation of the floating fountain is applicable for the understanding and design of the constituent components employed in the floating fountain devices and systems of this invention.

Figure 1:
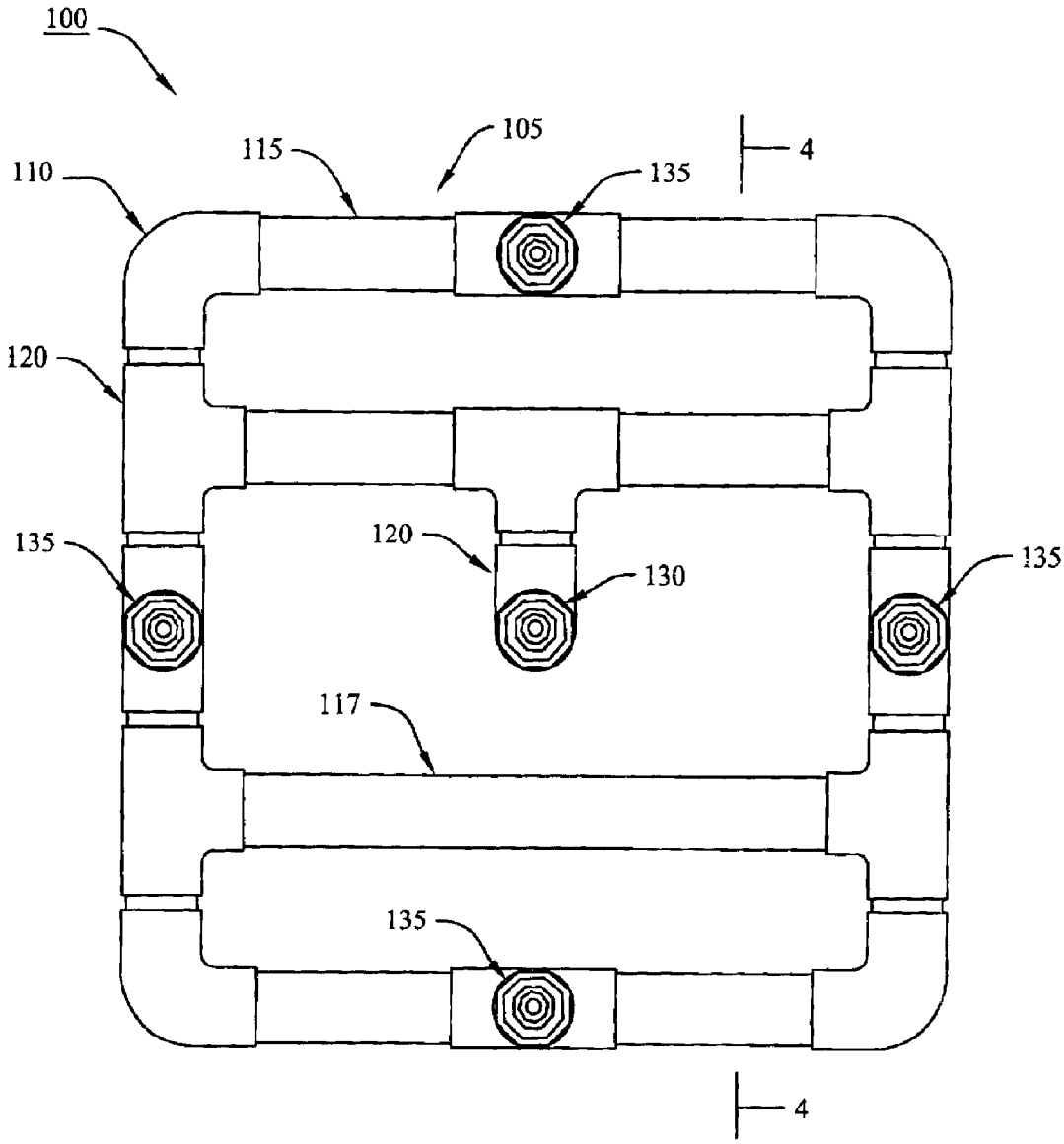
FIG. 1 is a top view of a first exemplary embodiment of a floating fountain according to this invention.
Figure 2:
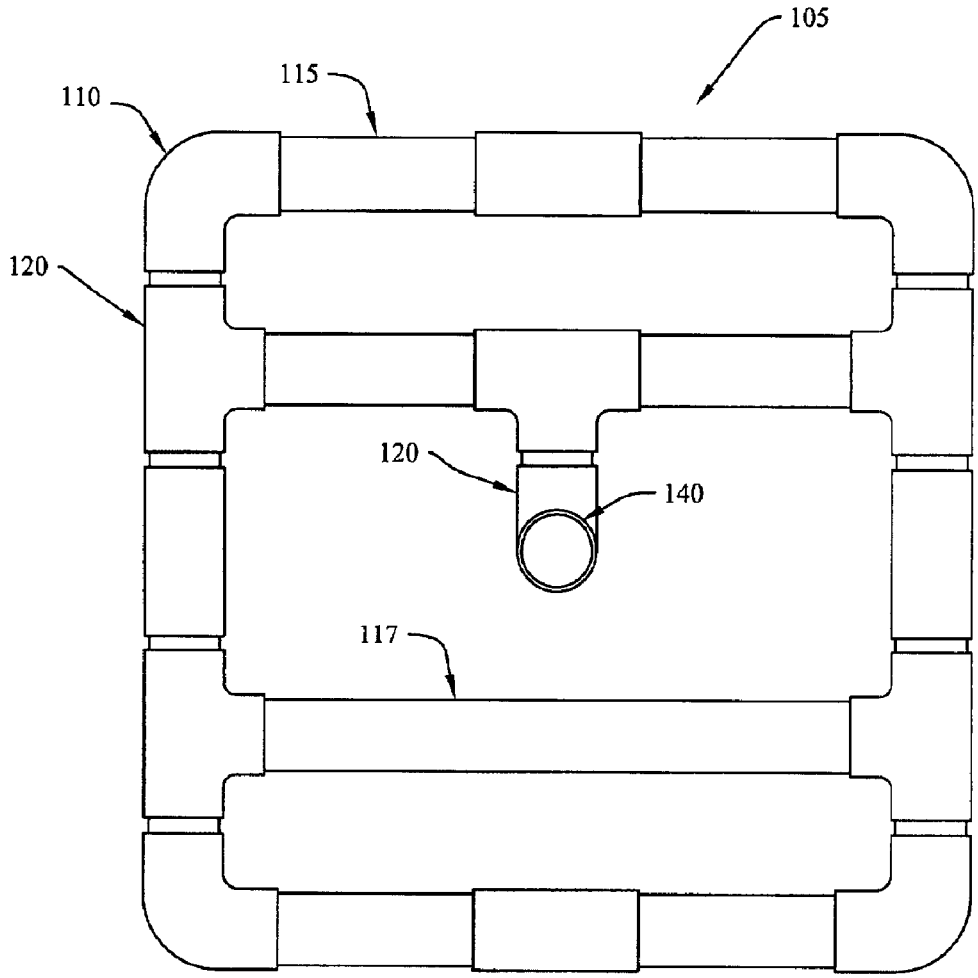
FIG. 2 is a bottom view of the first exemplary embodiment of the floating fountain of FIG. 1.
Figure 3:
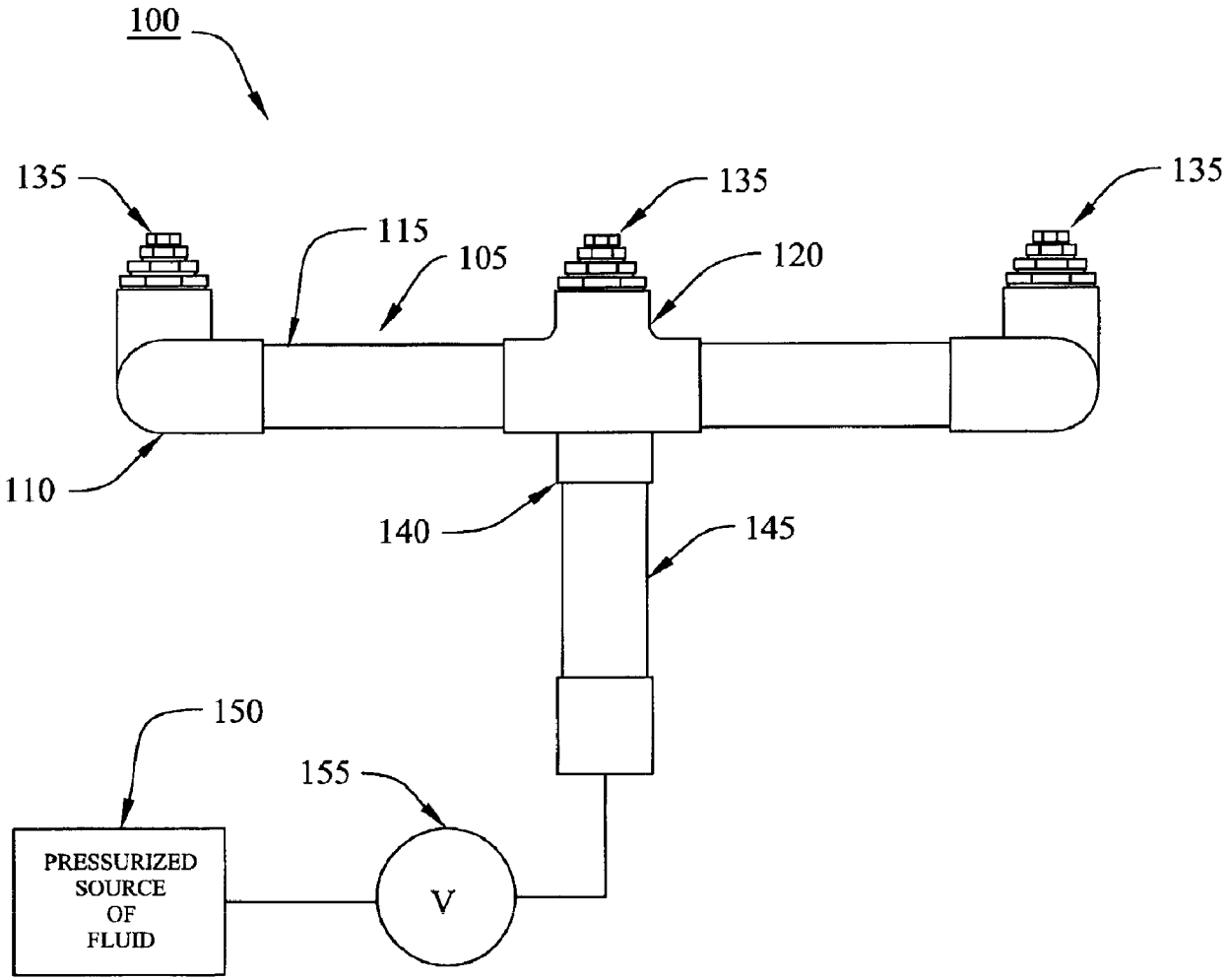
FIG. 3 is a side view of the first exemplary embodiment of the floating fountain of FIG. 1.
Figure 4:
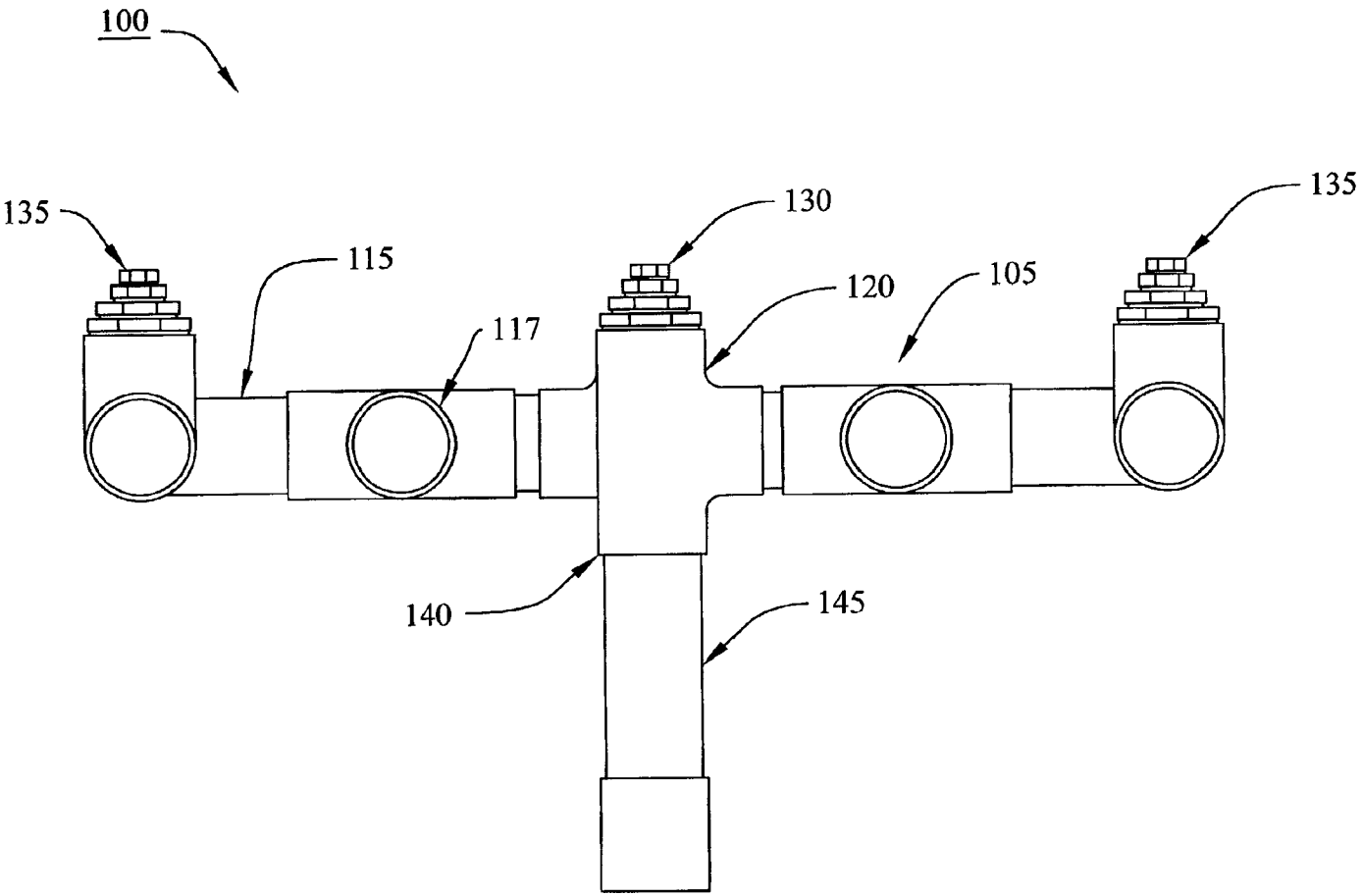
FIG. 4 is a schematic cross-sectional view taken along line 4—4 of the first exemplary embodiment of the floating fountain of FIG. 1.

FIGS. 1 through 3 show a top, a bottom, and a side view, respectively, of a first exemplary embodiment of a floating fountain 100 according to this invention. FIG. 4 shows a schematic cross-sectional view taken along line 4—4 of the first exemplary embodiment of the floating fountain 100 of FIG. 1. As shown in FIGS. 1 through 4, the floating fountain 100 comprises a base assembly 105, a primary nozzle member 130, at least one secondary nozzle member 135, and a connection member 140. Each of these elements is disposed in a communicating relation such that a pressurized fluid may effectively flow through the floating fountain 100.

As further shown in FIGS. 1 through 4, the base assembly 105 has a generally rectangular configuration, and is comprised of at least some of elbow fittings 110, a variety of hollow, tubular sections 115, and T-fittings 120. In various exemplary embodiments, the base assembly 105 includes a balancing tubular section 117. The balancing tubular section 117 assists the floating fountain 100 in maintaining a center of gravity near the connection member 140, when the floating fountain 100 is filled with fluid.

It should be appreciated that appropriate materials for these elements are selected based on the conditions that are expected to occur during use of the floating fountain 100. In various exemplary embodiments, these elements are comprised of Polyvinyl Chloride (PVC). The PVC elements may be constructed using schedule 40 or schedule 80 components, as necessary.

The connection member 140, which is located substantially centrally of the base assembly 105 and extends downwardly below a plane created by the base assembly 105, is capable of connecting, via a pressurized fluid supply line, the base assembly 105 to a pressurized source of fluid 150 and communicating the pressurized fluid to the base assembly 105. As illustrated in FIG. 3, the connection member 140 may include an extended connection member 145 for allowing the connection member 140 to receive the pressurized fluid.

As further illustrated in FIG. 3, in various exemplary embodiments, an infinitely variable valve 155 is disposed between the pressurized source of fluid 150 and the connection member 140. The infinitely variable valve 155 allows the pressure at which the pressurized fluid enters the base assembly 105, and ultimately the height of a resulting fountain display pattern, to be controlled. During normal operation, the pressure of the pressurized fluid within the floating fountain 100 is maintained between about 10 Pounds per Square Inch (psi) and about 130 psi, and the volume is maintained at above about 30 Gallons per Minute (GPM).

The primary nozzle member 130, which is located substantially above the connection member 140, in the approximate center of the floating fountain 100, is capable of receiving the pressurized fluid from the base assembly 105. Similarly, each secondary nozzle member 135 is connected to the base assembly 105, such that it is capable of receiving the pressurized fluid from the base assembly 105.

Figure 5:
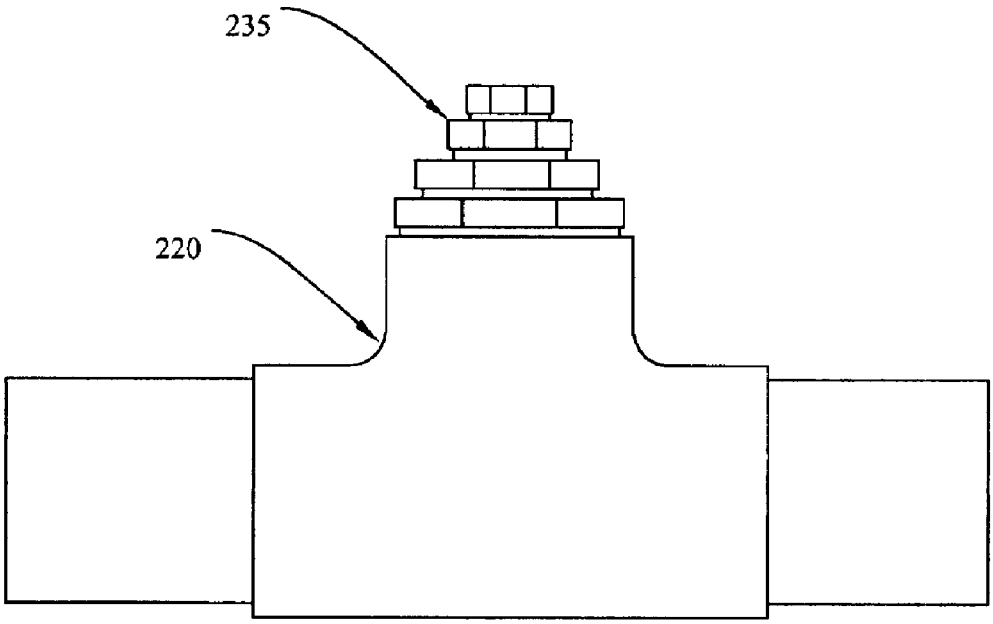
FIG. 5 is a side view of a first exemplary embodiment of a nozzle member according to this invention.

As further shown in FIGS. 5 through 9, in various exemplary embodiments of the floating fountain 100, either the primary nozzle member 130 or any of the secondary nozzle members 135 may comprise a variety of nozzle member components. For example, FIG. 5 shows a nozzle member 235 comprising a plurality of reduction fittings. The nozzle member 235 is coupled to a T-fitting 220. As shown in FIG. 5, a first reduction fitting is coupled to the T-fitting 220, a second reduction fitting is coupled to the first reduction fitting, a third reduction fitting is coupled to the second reduction fitting, and a fourth reduction fitting is coupled to the third reduction fitting. In this manner, the size of the aperture through which the stream of fluid will flow can be controlled.

It should be appreciated that the reduction fittings may be coupled to each other by a threaded means, a chemical bonding means, a thermal coupling, or any other currently known or later developed coupling means. It should also be appreciated that the nozzle member 235 may be formed of a single reduction fitting, which functionally replaces the plurality of reduction fittings.

Figure 6:
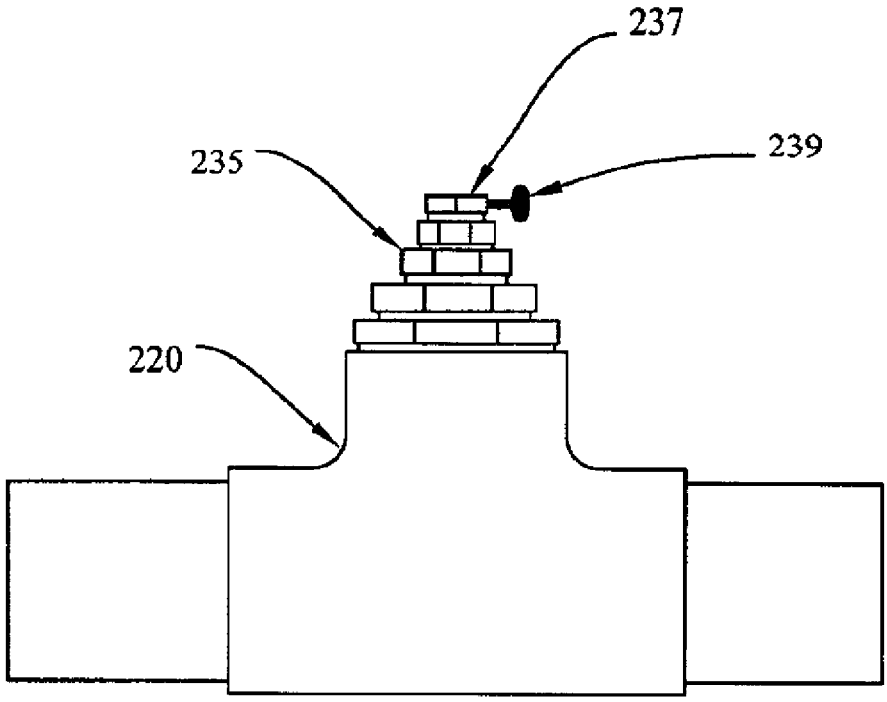
FIG. 6 is a side view of a second exemplary embodiment of a nozzle member according to this invention.
Figure 7:
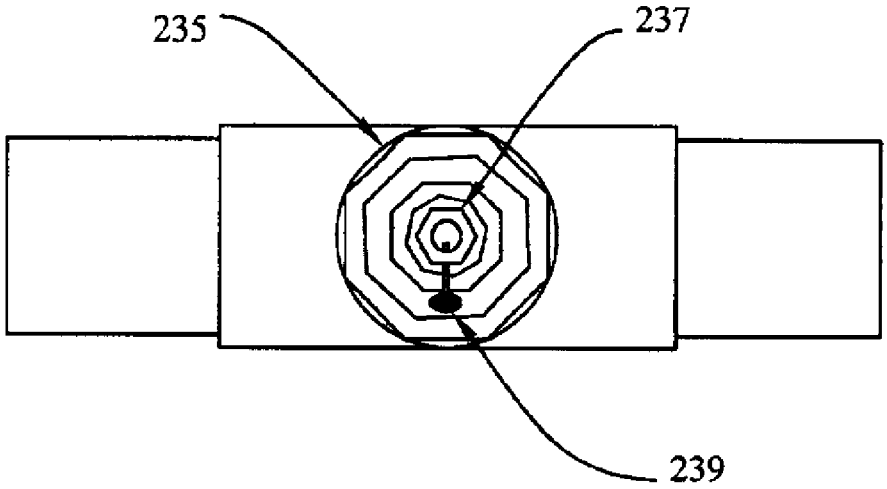
FIG. 7 is a top view of the second exemplary embodiment of the nozzle member of FIG. 6.

FIGS. 6 and 7 show the nozzle member 235 further comprising a final reduction fitting 237 and an adjustable fluid diffusion pin 239. As shown in FIGS. 6 and 7, the final reduction fitting 237 is coupled to the nozzle member 235, as described above with reference to FIG. 5. The adjustable fluid diffusion pin 239 is inserted in the final reduction fitting 237 such that the adjustable fluid diffusion pin 239 is capable of protruding into the aperture of the final reduction fitting 237.

In various exemplary embodiments, the adjustable fluid diffusion pin 239 is a threaded pin, or screw, which can be adjusted to interfere with the stream of fluid as it flows through the final reduction fitting 237 and diffuse the stream of fluid flowing therethrough. In this manner, a concentrated jet of fluid can be diffused into a wider stream of fluid to produce a desired fountain display pattern.

Figure 8:
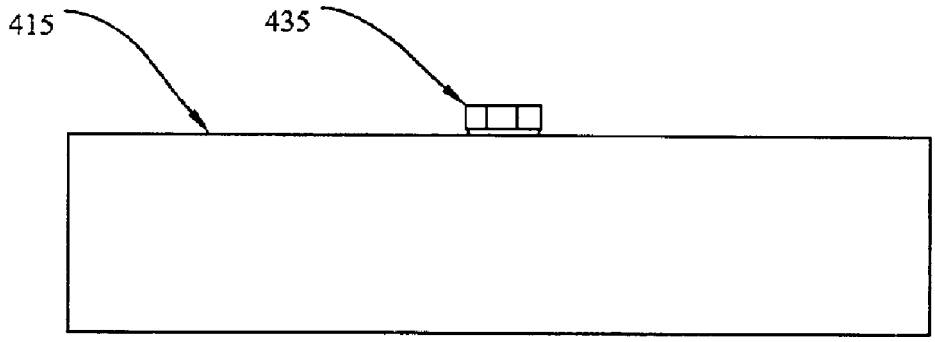
FIG. 8 is a side view of a third exemplary embodiment of a nozzle member according to this invention.
Figure 9:
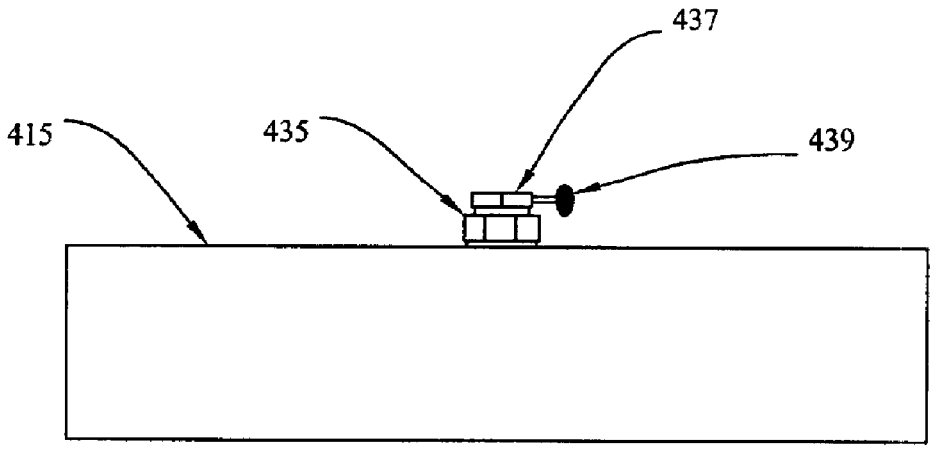
FIG. 9 is a side view of a fourth exemplary embodiment of a nozzle member according to this invention FIG. 10 a top view of a first exemplary embodiment of a floating fountain assembly according to this invention.

FIG. 8 shows a nozzle member 435 comprising a single reduction fittings coupled to a tubular section 415, and FIG. 9 shows the nozzle member 435 further comprising a final reduction fitting 437 and an adjustable fluid diffusion pin 439.

It should be appreciated that any one or a combination of the nozzle members described above, with reference to FIGS. 5 through 9, may be used to replace either the primary nozzle member 130 or any of the secondary nozzle members 135 described herein. It should also be appreciated that, in various exemplary embodiments of the floating fountain 100, the primary nozzle member 130 or any of the secondary nozzle members 135 described herein may be replaced by an aperture, or hole, formed in the base assembly 105 sufficient to allow a stream of fluid to flow from the base assembly 105. Furthermore, it should be understood that a blocking screw or cap (not shown) may be positioned such that any nozzle member or aperture is blocked, preventing the stream of fluid from flowing therefrom.

Figure 10:
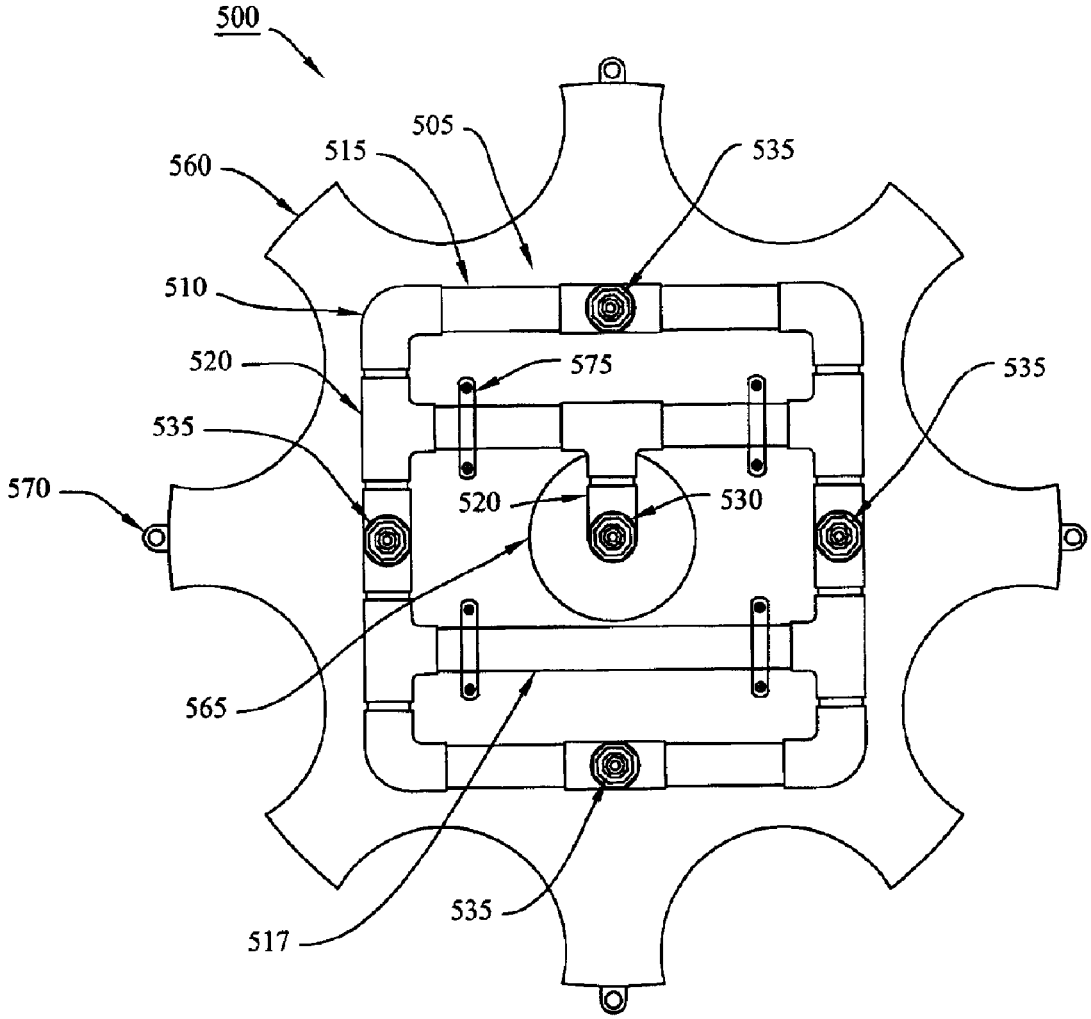
Figure 11:
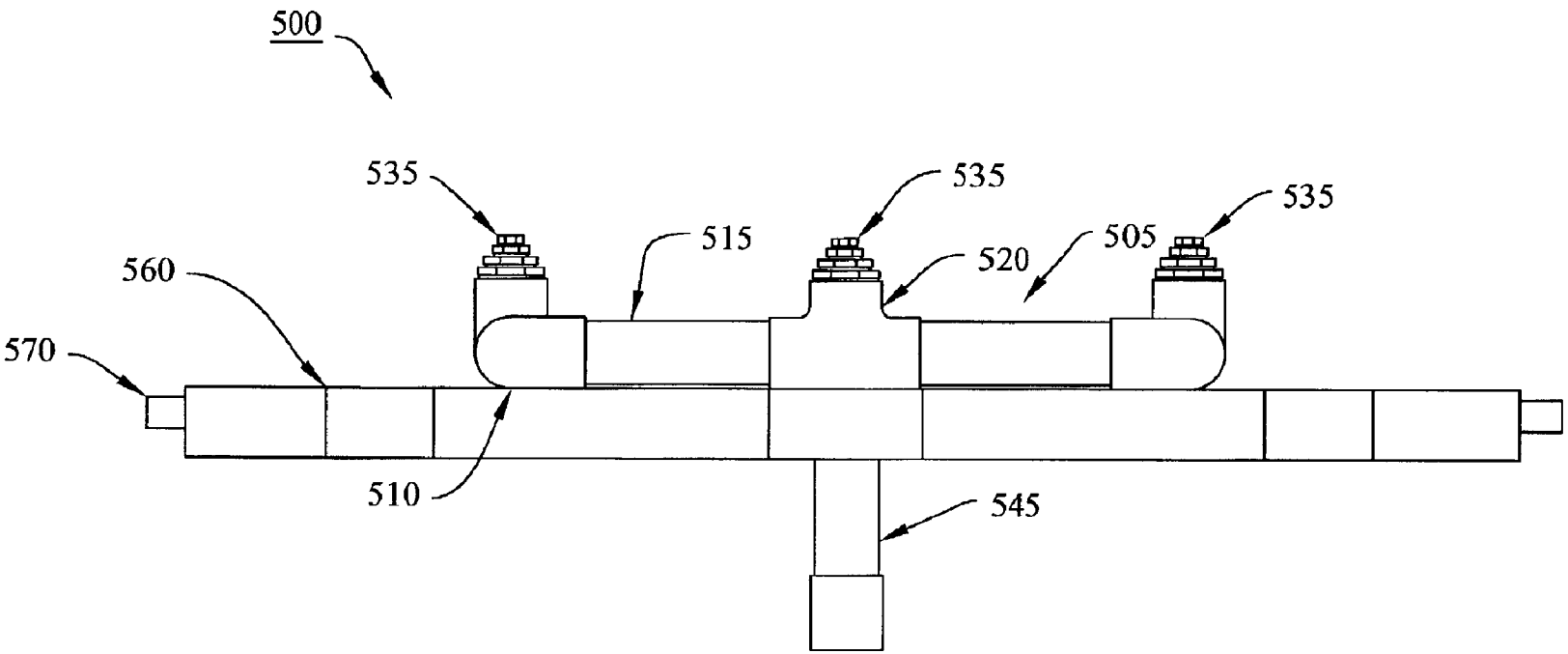
FIG. 11 a side view of the first exemplary embodiment of the floating fountain assembly of FIG. 10.

FIGS. 10 and 11 show a top and a side view, respectively, of a first exemplary embodiment of a floating fountain assembly 500 according to this invention. As shown in FIGS. 10 and 11, the floating fountain assembly 500 comprises a base assembly 505, elbow fittings 510, a variety of hollow, tubular sections 515, a balancing tubular section 517, T-fittings 520, a primary nozzle member 530, at least one secondary nozzle member 535, a connection member 540, and an extended connection member 545.

The elements listed above correspond to and operate similarly to the same elements discussed above with respect to FIGS. 1 through 4.

Optionally, the floating fountain assembly 500 may include any one or a combination of the nozzle members, blocking screws, or caps described above, with reference to FIGS. 5 through 9.

However, the floating fountain assembly 500 also includes a float body 560 affixed to a bottom side of the base assembly 505. The float body 560 may be a hollow or a filled float body, which provides sufficient buoyancy to maintain the base assembly 505 at an operable height above the surface of the water in a lake or pond, while the floating fountain assembly 500 is operating. Although the float body 560 shown in FIG. 10 is generally circular, it should be appreciated that the float body 560 may take a variety of shapes so long as the shape chosen for the float body 560 allows sufficient buoyancy to maintain the base assembly 505 at an operable height above the surface of the water.

The base assembly 505 is affixed to the float body 560 by way of attaching brackets 575. The float body 560 includes several anchor loops 570, such that the floating fountain assembly 500 may be held in position in a lake by shoreline or anchor ropes.

The float body 560 also includes an aperture 565 which is sufficient to allow the connection member 540 (not shown) and/or the extended connection member 545 to pass from a top side of the float body 560 to a bottom side of the float body 560. In various exemplary embodiments, the aperture 565 may be replaced by a set of connectors, wherein the connection member 540 is connectable to a first connector and a pressurized fluid supply line is connectable to a second connector, such that the pressurized fluid may be communicated, via the set of connectors, from the pressurized fluid supply line to the connection member 540.

During operation of the floating fountain assembly 500, the size, height, and overall configuration of the particular fountain display pattern that the floating fountain assembly 500 is to exhibit is determined. For example, if a multi-tier fountain display pattern, such as, a rocket with a narrow trumpet is to be exhibited, the primary nozzle member 530 is configured to remain open to allow a concentrated jet of fluid to flow from the primary nozzle member 530 to form the rocket. Each of the secondary nozzle members 535 is configured to include a final reduction fitting 537 (not shown) and an adjustable fluid diffusion pin 539 (not shown). Each of the adjustable fluid diffusion pins 539 (not shown) is adjusted to produce the desired degree of fluid diffusion for the trumpet portion of the display.

When the nozzle member settings are established, the connection member 540 is connected to a pressurized source of fluid 550 (not shown), and the floating fountain assembly 500 is positioned, via the shoreline or anchor ropes, in the lake. Once the floating fountain assembly 500 has been appropriately positioned, an infinitely variable valve 555 (not shown), disposed between and in communication with the pressurized source of fluid 550 (not shown) and the connection member 540, is opened and pressurized fluid is permitted to flow from the pressurized source of fluid 550 (not shown) to the base assembly 505.

Because of the location of the primary nozzle member 530 in relation to the connection member 540, and the flow of the pressurized fluid within the base assembly 505, the primary nozzle member 530 produces the desired rocket fountain display, while the secondary nozzle members 535 produce a lower, diffused trumpet fountain display. Once a flow of pressurized fluid is established, an adjustment to the infinitely variable valve 555 (not shown) will alter the height of the display.

It should be appreciated that although the embodiments of this invention are described and shown with reference to a generally rectangular floating fountain, the generally rectangular shape of the floating fountain described and shown herein is for a basic explanation and understanding of certain of the constituent components of the floating fountain of this invention. Therefore, the generally rectangular shape of the floating fountain shown herein is not to be construed as limiting this invention, but should be understood to allow alternative geometries, such as, for example, generally circular, triangular, quadrangular, pentangular, sexangular, septangular, octagonal, or other geometries, to be included with or substituted for the generally rectangular shape of the floating fountain described and shown herein.

Likewise, although the embodiments of this invention are described and shown with reference to a floating fountain having a base assembly comprised of a single outer portion having four secondary nozzle members, it should be appreciated that the placement of the four secondary nozzle members, as described and shown herein, is merely exemplary and the floating fountain may include, for example, multiple concentric portions and multiple secondary nozzle members dispersed among the concentric portions.

It should also be appreciated that although the nozzle members described and shown herein are described and shown as being disposed at a 90 degree angle with the plane created by the base assembly, in various exemplary embodiments, any of the nozzle members may be disposed at an angle of less than 90 degree with the plane created by the base assembly. Likewise, in various other exemplary embodiments, any of the nozzle members may be disposed at an angle greater than 90 degree with the plane created by the base assembly.

While this invention has been described in conjunction with the exemplary embodiments outlined above, it is evident that many alternatives, modifications, and variations will be apparent to those skilled in the art. For example, depending on the desired fountain display pattern of the floating fountain devices or systems described herein, the particular configuration and disposition of the base assembly and each nozzle member will be a design choice and will be obvious and predicable to those skilled in the art. Accordingly, the exemplary embodiments of the invention, as set forth above, are intended to be illustrative, not limiting. Various changes may be made without departing from the spirit and scope of the invention.

What is claimed is:

1. A floating fountain comprising:

a tubular, hollow base assembly;

a tubular, hallow connection member located substantially centrally of the base assembly, extending downwardly below a plane created by the base assembly, and in communicating relation with the base assembly, such that the connection member allows the base assembly to be connected in a communicating relation to a pressurized source of fluid, wherein the pressurized source of fluid provides the fluid at a pressure of between about 10 psi and about 130 psi and a volume above about 30 GPM;

a primary nozzle member located above the connection member, extending upwardly from the plane created by the base assembly, and in communicating relation with the connection member and the base assembly, such that fluid from the pressurized source of fluid may be communicated to the primary nozzle member;

a plurality of secondary nozzle members mounted to the base assembly, extending upwardly from the plane created by the base assembly, and in communicating relation with the base assembly, such that fluid from the pressurized source of fluid may be communicated to each of the secondary nozzle members; and a float body affixed to a bottom side of the base assembly, wherein the float body includes an aperture for allowing the connection member to pass from a top side of the float body to a bottom side of the float body.

2. The floating fountain of claim 1, wherein the pressurized source of fluid is an irrigation system.

3. The floating fountain of claim 1, wherein the pressurized source of fluid is indirectly coupled to the connection member.

4. The floating fountain of claim 1, wherein the pressurized source of fluid is a pump.

5. The floating fountain of claim 4, wherein the pump is not directly attached to the primary nozzle member.

6. The floating fountain of claim 1, further comprising an infinitely variable valve disposed between the pressurized source of fluid and the connection member, whereby the pressure at which the pressurized fluid is communicated to the base assembly and is communicated to each nozzle member is variable.

7. A floating fountain comprising:

a tubular, hollow base assembly;

a tubular, hollow connection member, disposed for receiving pressurized fluid from a pressurized source of fluid and communicating the pressurized fluid to the base assembly, wherein the pressurized source of fluid is located remote from the floating fountain;

a primary nozzle member, disposed for receiving pressurized fluid from the base assembly and providing a stream of fluid that extends substantially upwardly from the plane created by the base assembly;

a plurality of secondary nozzle members, each secondary nozzle member being disposed for receiving pressurized fluid from the base assembly and providing a stream of fluid;

a float body affixed to a bottom side of the base assembly, wherein the float body includes an aperture for allowing the connection member to pass from a top side of the float body to a bottom side of the float body.

8. The floating fountain of claim 7, wherein the base assembly is a substantially rectangular base assembly.

9. The floating fountain of claim 7, wherein the base assembly comprises an inner base assembly and at least one outer base assembly.

10. The floating fountain of claim 7, wherein each nozzle member is capable of being blocked preventing the stream of fluid from flowing therethrough.

11. The floating fountain of claim 7, wherein at least one nozzle member includes a fluid diffusion pin for diffusing the stream of fluid flowing therethrough.

12. The floating fountain of claim 11, wherein the fluid diffusion pin is adjustable, such that the level of diffusion of the stream of fluid flowing therethrough is adjustable.

13. The floating fountain of claim 7, wherein the connection member is located substantially centrally of the base assembly.

14. The floating fountain of claim 7, wherein the connection member extends downwardly below a plane created by the base assembly.

15. The floating fountain of claim 7, wherein the pressurized fluid is provided at a pressure of between about 10 psi and about 130 psi.

16. The floating fountain of claim 7, wherein the pressurized fluid is provided at a volume above about 30 GPM.

17. The floating fountain of claim 7, wherein the pressurized source of fluid is an irrigation system.

18. The floating fountain of claim 7, wherein the pressurized source of fluid is indirectly coupled to the connection member.

19. The floating fountain of claim 7, wherein the pressurized source of fluid is a pump.

20. The floating fountain of claim 19, wherein the pump is not directly attached to the primary nozzle member.

21. The floating fountain of claim 7, wherein each nozzle member is an aperture.

22. The floating fountain of claim 7, wherein each nozzle member comprises at least one reduction fitting, coupled to the base assembly.

23. The floating fountain of claim 7, wherein each nozzle member comprises a plurality of reduction fittings, a first reduction fitting coupled to the base assembly and at least one second reduction fitting coupled to the first reduction fitting.

24. The floating fountain of claim 7, wherein the primary nozzle member is located substantially above the connection member.

25. The floating fountain of claim 7, wherein each of the secondary nozzle members is located on the base assembly.

26. The floating fountain of claim 7, wherein at least one of the secondary nozzle members is disposed at a 90 degree angle with the plane created by the base assembly.

27. The floating fountain of claim 7, wherein at least one of the secondary nozzle members is disposed at an angle of less than 90 degree with the plane created by the base assembly.

28. The floating fountain of claim 7, wherein at least one of the secondary nozzle members is disposed at an angle greater than 90 degree with the plane created by the base assembly.

29. The floating fountain of claim 7, further comprising an infinitely variable valve disposed between the pressurized source of fluid and the connection member, whereby the pressure at which the pressurized fluid enters the base assembly and is provided to each nozzle member is variable.

30. A floating fountain system comprising in combination:

a pressurized source of fluid capable of providing a fluid at a pressure of between about 10 psi and about 130 psi, and a volume above about 30 GPM, wherein the pressurized source of fluid is located remote from the floating fountain;

a tubular, hollow base assembly, wherein the base assembly includes, a tubular, hollow connection member, disposed for receiving pressurized fluid from the pressurized source of fluid and communicating the pressurized fluid to the base assembly;

a primary nozzle member, disposed for receiving pressurized fluid from the base assembly and providing a stream of fluid that extends substantially upwardly from the plane created by the base assembly; and a plurality of secondary nozzle members, each secondary nozzle member being disposed for receiving pressurized fluid from the base assembly and providing a stream of fluid;

an infinitely variable valve disposed between the pressurized source of fluid and the connection member, whereby the pressure at which the pressurized fluid enters the base assembly and is provided to each nozzle member is variable; and a float body affixed to a bottom side of the base assembly.

31. The floating fountain system of claim 30, wherein the connection member extends downwardly below a plane created by the base assembly.

32. The floating fountain system of claim 30, wherein the pressurized source of fluid is an irrigation system.

33. The floating fountain system of claim 30, wherein the pressurized source of fluid is indirectly coupled to the connection member.

34. The floating fountain system of claim 30, wherein the pressurized source of fluid is a pump.

35. The floating fountain system of claim 34, wherein the pump is not directly attached to the primary nozzle member.

* * * * *